US008070255B2

(12) United States Patent
Shinkawa

(10) Patent No.: US 8,070,255 B2
(45) Date of Patent: Dec. 6, 2011

(54) LIQUID EJECTING APPARATUS

(75) Inventor: Osamu Shinkawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 343 days.

(21) Appl. No.: 12/400,953

(22) Filed: Mar. 10, 2009

(65) Prior Publication Data

US 2009/0231387 A1 Sep. 17, 2009

(30) Foreign Application Priority Data

Mar. 11, 2008 (JP) ..... 2008-060681
Nov. 5, 2008 (JP) ..... 2008-284121

(51) Int. Cl.
*B41J 2/165* (2006.01)
*B41J 2/01* (2006.01)

(52) U.S. Cl. ..... 347/34; 347/102

(58) Field of Classification Search ..... 347/22, 347/34, 55, 102, 104
See application file for complete search history.

(56) References Cited

U.S. PATENT DOCUMENTS 7,387,367 B2 * 6/2008 Furukawa et al. ..... 347/55

FOREIGN PATENT DOCUMENTS

| | | |
|---|---|---|
| JP | 04-083645 | 3/1992 |
| JP | 2003-072059 | 3/2003 |
| JP | 2007-055002 | 3/2007 |

* cited by examiner

*Primary Examiner* — An Do
(74) *Attorney, Agent, or Firm* — Workman Nydegger

(57) ABSTRACT

There is provided a liquid ejecting apparatus having a non contact type heater for heating a recording medium on which liquid is ejected via a liquid ejecting head, the heater having a heat generating surface and the heater being arranged in parallel to the liquid ejecting head along a transport direction of the recording medium. The liquid ejecting apparatus includes a mist suctioning unit for suctioning floating mist generated by ejection of the liquid. The mist suctioning unit includes a nozzle plate in which nozzle orifices for ejecting the liquid are formed, the nozzle plate being provided on the liquid ejecting head, an electrode member provided at a marginal portion of the heat generating surface, and an electric potential difference generator for generating an electric potential difference between the electrode member and the nozzle plate to electrostatically absorb the mist on the marginal portion of the heat generating surface.

5 Claims, 4 Drawing Sheets

LIQUID EJECTING APPARATUS

BACKGROUND

1. Technical Field

The present invention relates to a liquid ejecting apparatus.

2. Related Art

Generally, an ink jet recording apparatus as one of liquid ejecting apparatuses is equipped with a recording head (liquid ejection head) in which a nozzle for ejecting ink (liquid) is provided, and printing is performed by ejecting ink to a recording medium from the nozzle (for example, see JP-A-2003-72059 (hereinafter, referred to as Patent Document 1)). In the ink jet recording apparatus described in Patent Document 1, it is necessary to dry the ink ejected on a recording surface of a recording medium to fix the ink on the recording surface. Accordingly, a halogen heater for heating the recording surface of the recording medium is provided at a downstream side of the recording head in a path way through which the recording medium is transported. Non contact heating is performed at the recording surface side of the recording medium by the halogen heater. The ink ejected on the recording surface can be efficiently dried with the heating of the recording surface.

Incidentally, in the ink jet recording apparatus of Patent Document 1, a heat unit shielding member (heat resistance member) for partitioning the halogen heater and the transport pathway is provided. The heat unit shielding member prevents ignition of the recording member that is entered at the halogen heater side. However, when ink is ejected on the recording surface of the recording medium, a large amount of ink mist is generated. Accordingly, there is a fear that the floating ink mist is adhered on a heat generating surface of the heat unit shielding member and is dried and stuck, thereby reducing the light amount of the halogen heater to lower drying efficiency.

SUMMARY

An advantage of some aspects of the invention is to provide a liquid ejecting apparatus capable of preventing a problem that a light amount of a heat generating surface is reduced.

According to an aspect of the invention, there is provided a liquid ejecting apparatus having a non contact type heater for heating a recording medium on which liquid is ejected via a liquid ejecting head, the heater having a heat generating surface and the heater being arranged in parallel to the liquid ejecting head along a transport direction of the recording medium. The liquid ejecting apparatus includes a mist suctioning unit for suctioning floating mist generated by ejection of the liquid. The mist suctioning unit includes a nozzle plate in which nozzle orifices for ejecting the liquid are formed, the nozzle plate being provided on the liquid ejecting head, an electrode member provided at a marginal portion of the heat generating surface, and an electric potential difference generator for generating an electric potential difference between the electrode member and the nozzle plate to electrostatically absorb the mist on the marginal portion of the heat generating surface.

According to the aspect of the invention, the mist suctioning unit for suctioning mist floated by ejection of liquid is provided. Accordingly, the floating mist is suctioned by the mist suctioning unit. In addition, the flouting mist can be electrostatically absorbed on the marginal portion of the heat generating surface by the electric potential difference generator for generating an electric potential difference between the electrode member and the nozzle plate. Accordingly, a problem that the floating mist is adhered at the center of the heat generating surface to reduce a light amount can be prevented.

It is preferable that the electrode member is formed by a thin film made of a metal, and the thin film made of the metal is attached at the marginal portion of the heat generating surface in the liquid ejecting apparatus according to the aspect of the invention.

Herewith, the electrode member can be provided at the marginal portion of the heat generating surface with a simple structure.

It is preferable that a heat resistance member for partitioning the heater and a transport mechanism for transporting the recording medium is provided, the heat resistance member includes the heat generating surface, the electrode member is made of a metal wiring, and the metal wiring is embedded in the heat resistance member at the marginal portion of the heat generating surface in the liquid ejecting apparatus according to the aspect of the invention.

Herewith, since the electrode member is embedded in the heat resistance member, the marginal portion of the heat generating surface can be cleaned without slidingly contact with the electrode member when the ink mist electrostatically absorbed on the marginal portion of the heat generating member is cleaned.

It is preferable that mist suctioning unit suctions the mist by a negative pressure generator for generating a negative pressure in a space in which the mist is floated in the liquid ejecting apparatus according to the aspect of the invention.

Herewith, since the floating mist can be suctioned by the negative pressure generator for generating a negative pressure in the space in which the mist is floated, the problem that the floating mist is adhered on the heat generating surface to reduce the light amount can be prevented.

It is preferable that the negative pressure generator is arranged in parallel to the liquid ejecting head along the transport direction of the recording medium at least any one of between the liquid ejecting head and the heater and at the side opposite to the heater with the liquid ejecting head interposed therebetween in the liquid ejecting apparatus according to the aspect of the invention.

Herewith, since the negative pressure generator is arranged in parallel to the liquid ejecting head along the transport direction of the recording medium at least any one of between the liquid ejecting head and the heater and at the side opposite to the heater with the liquid ejecting head interposed therebetween, the negative pressure generator can be provided near the space in which the mist is floated. Accordingly, it becomes easy to absorb the floating mist.

It is preferable that the negative pressure generating means has a suction opening for suctioning the mist, and an opening face of the suction opening is opened towered the space and a liquid ejection area by the liquid ejecting head in the liquid ejecting apparatus according to the aspect of the invention.

Herewith, since the opening face of the suction opening for suctioning the mist is opened toward the liquid ejection area by the liquid ejecting head, it becomes easy that floating mist is suctioned toward the suction opening.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a liquid ejecting apparatus of the invention realized by a printer will be described with reference to FIG. 1 to FIG. 4.

Figure 1:
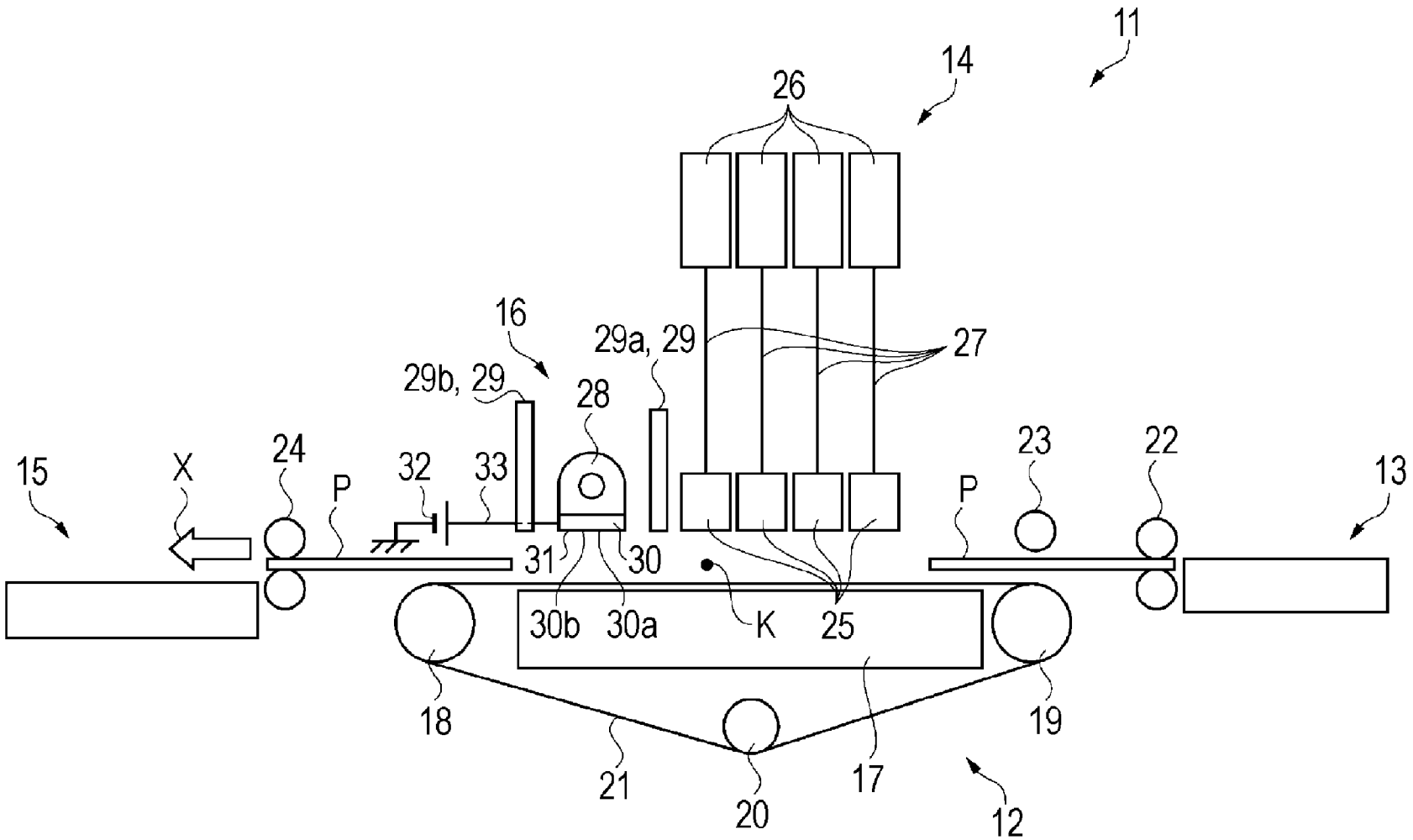
FIG. 1 is a side view schematically showing an ink jet type printer according to a first embodiment.

As shown in FIG. 1, an ink jet type printer (hereinafter, simply referred to as "printer") 11 as a liquid ejecting apparatus includes a transport unit 12 as a transport mechanism for transporting a recording medium, a paper feed unit 13, a recording unit 14, a paper discharge unit 15, and a heat unit 16. A support stand 17 is provided in the transport unit 12, and a driving roller 18, a driven roller 19, and a tension roller 20 are arranged to surround the support stand 17. An endless transport belt 21 is wrapped around the driving roller 18, the driven roller 19, and the tension roller 20. The transport belt 21 is supported by the support stand 17 so as to be level from the lower direction between the driving roller 18 and the driven roller 19. Then, a paper P as a recording medium is to be transported in a transport direction (direction shown by the arrow X in FIG. 1) by the transport belt 21.

A pair of gate rollers 22 that are driven when the paper P is transported from the paper feed unit 13 to the transport belt 21. Further, a depressing roller 23 for depressing the paper P on the transport belt 21 is provided above the driven roller 19 in the transport unit 12. Further, a pair of discharge rollers 24 for discharging the paper P to the discharge unit 15 from the transport belt 21 is provided in the transport unit 12.

The recording unit 14 is provided above the support stand 17. Four recording heads 15 as line-like liquid ejecting heads extending in the direction (width direction of the transport belt 21) perpendicular to the transport direction of the paper P are provided in the recording unit 14. Further, an ink cartridge 26 which stores ink having a different color is connected to each of the recording head 25 via an ink tube 27. Further the heat unit 16 is provided at the downstream side of the recording unit 14 in the transport direction of the paper P. The heat unit 16 dries ink that is ejected on a recording surface of the paper P from the recording heads 25. The heat unit 16 is arranged in parallel to the recording heads 25 along the transport direction of the paper P.

Figure 2:
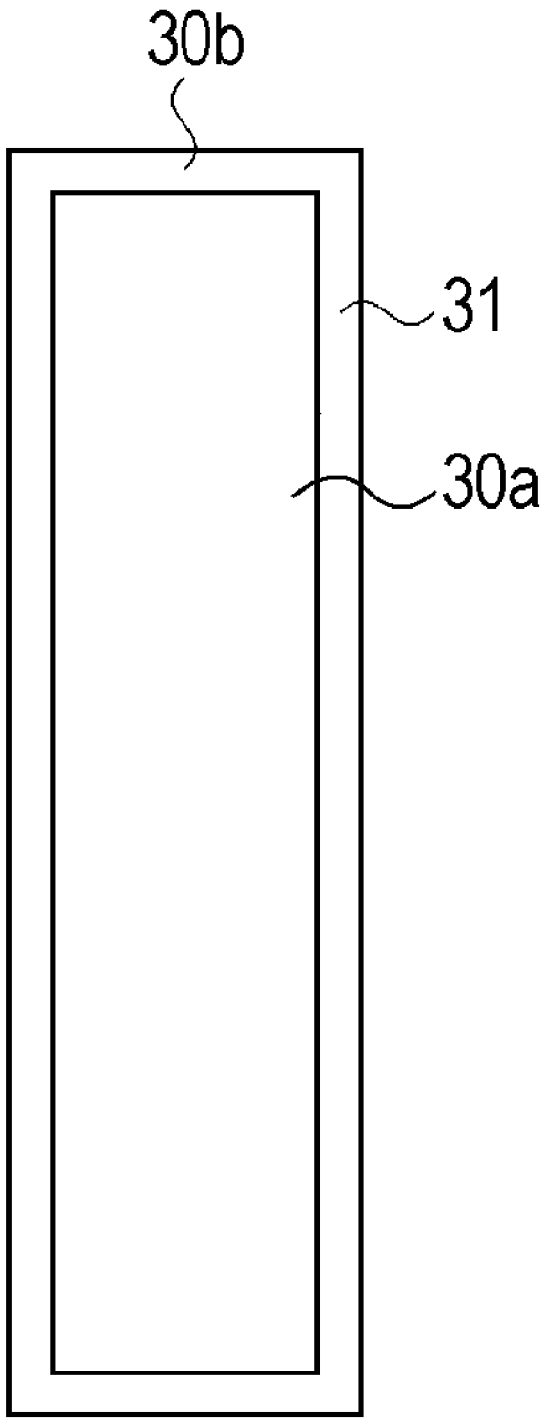
FIG. 2 is a plan view showing a heat generating surface.

The heat unit 16 has a halogen heater 28 for drying ink ejected on the paper P and a heat insulating material 29 provided to sandwich the halogen heater 28 from both sides. The heat insulating material 29 is constituted by a first heat insulating material **29*a* provided between the recording heads 25 and the halogen heater 28, and a second heat insulating material 29*b* provided opposite to the first heat insulating material 29*a* with the halogen heater 28 interposed therebetween. Further, a heat resistance glass 30 as a heat resistance member for partitioning the halogen heater 28 and the transport belt 21 is provided in the halogen heater 28. The heat resistance glass 30 has a heat generating surface 30*a* from which heat of the halogen heater 28 is emitted toward the paper P. The heat generating surface 30*a* has a rectangular shape as shown in FIG. 2 and the longitudinal direction of the heat generating surface 30*a* is coincident with the width direction of the transport belt 21. That is, the head unit 16 is constituted by the halogen heater 28, the heat insulating material 29, and the heat resistance glass 30 having the heat generating surface 30*a* to constitute heat means. An electrode member 31 is provided at a marginal portion 30*b* of the heat generating surface 30*a* of the heat resistance glass 30. The electrode member 31 is constituted by a thin film made of a metal and the thin film made of a metal is attached on the marginal portion 31*b* of the heat generating surface 30*a* so as to surround the center of the heat generating surface 30*a* as shown in FIG. 2. The electrode member 31 is provided on approximately the same plane as the heat generating surface 30*a***.

Figure 3:
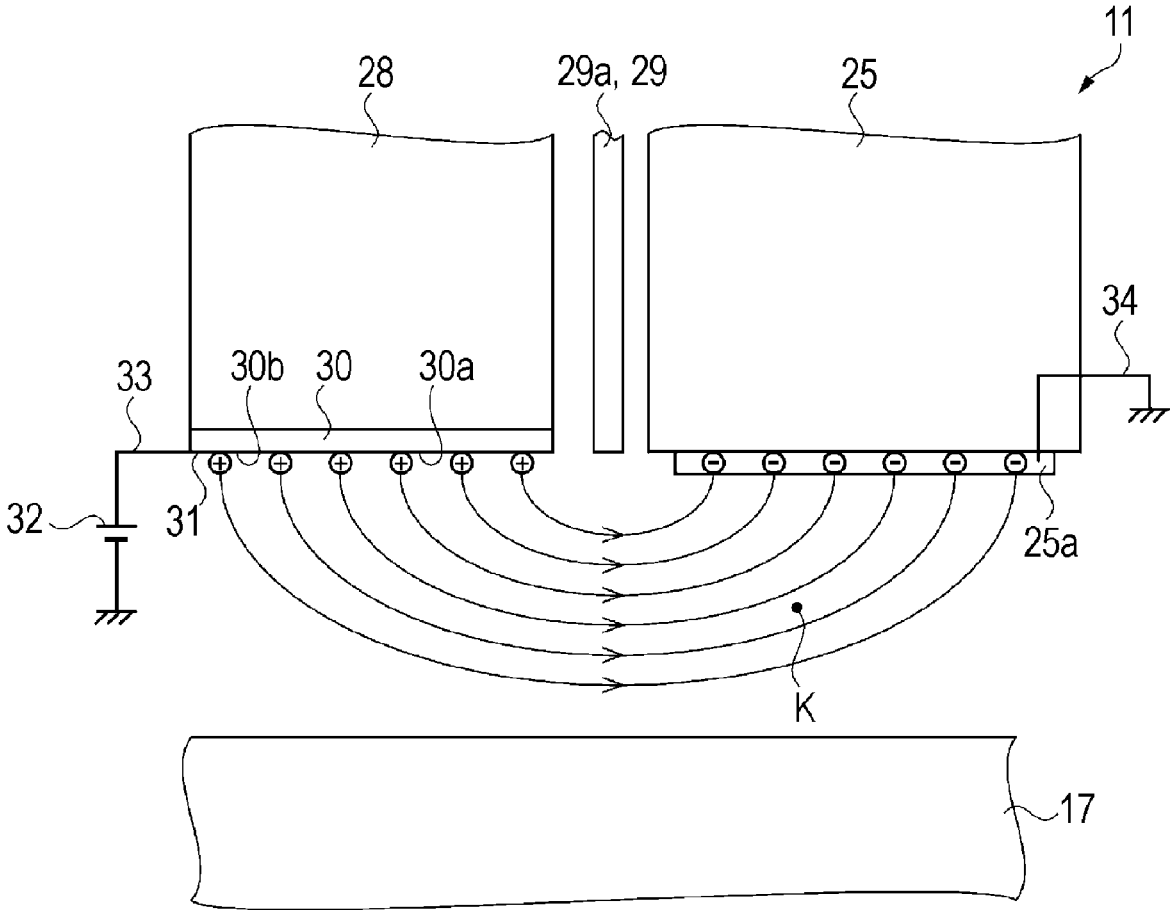
FIG. 3 is a diagram schematically showing electric flux lines generated by electric potential difference generating means of the ink jet type printer.

As shown in FIG. 3, a power source 32 for applying a positive voltage to the electrode member 31 is provided in the printer 11. One end of a wiring 33 is connected to the power source 32 and the other end of the wiring 33 is connected to the electrode member 31. Further, a nozzle plate 25 in which nozzle orifices (not shown) for ejecting ink are formed is provided at a distal end of the recording head 25. A wiring 34 for grounding the nozzle plate **25*a* is connected to the nozzle plate 25*a*. The power source 32 and the wirings 33, 34 constitute electric potential difference generating means for generating an electric potential difference between the nozzle plate 25*a* and the electrode member 31**.

By applying a positive voltage to the electrode member 31 and by grounding the nozzle plate **25*a* by the electric potential difference generating means, a positive charge is induced on the electrode member 31 and a negative charge is induced on the nozzle plate 25*a* as shown by FIG. 3. Herewith, as shown by the arrows in FIG. 3, electric flux lines that are oriented to the nozzle plate 25*a* from the electrode member 31 are generated in an ejection space K. The ejection space K is a liquid ejection area by the recording head 25, and is also a space in which ink mist generated by ejection of ink is floated. The ink ejected from the recording head 25 is ejected from the nozzle orifices to have a negative charge corresponding to the area of the nozzle orifices. Accordingly, a coulomb force is applied to the ink mist generated by ejection of ink on the recording surface of the paper P from the recording head 25 toward the direction of the electrode member 31 as a negative charge is provided in the ink mist. With the coulomb force, the ink mist is drawn toward the electrode member 31 from the ejection space K by electrostatic induction, and is electrostatically absorbed on the marginal portion 30*b* of the heat generating surface 30*a* at which the electrode member 31 is provided. That is, the electric potential difference generating means, the electrode member 31, and the nozzle plate 25*a* constitute mist suction means for suctioning ink mist. Further, it is preferable to provide cleaning means for periodically cleaning the ink mist that is electrostatically absorbed on the electrode member 31** in the embodiment.

The effects described below can be obtained in the first embodiment (1) By providing mist suction means for suctioning the ink mist floated by ejection of ink in the printer 11, the ink mist floated in the ejection space K is suctioned by the mist suction means. In addition, by providing the electrode member 31 at the marginal portion **30*b* of the heat generating surface 30*a* and by the electric potential difference generating means that generates an electric potential difference between the nozzle plate 25*a* and the electrode member 31, the ink mist floated in the ejection space K is electrostatically absorbed on the marginal portion 30*b* of the heat generating surface 30*a*. Accordingly, since the floating ink mist can be electrostatically absorbed on the marginal portion 30*b* of the heat generating surface, the problem that the floating ink mist is adhered at the center of the heat generating surface 30*a*** to reduce light amount can be prevented.

(2) The electrode member 31 is formed by a thin film made of a metal and the thin film made of a metal is attached at the marginal portion 30*b* of the heat generating surface 30*a*. According to the structure, the electrode member 31 can be provided at the marginal portion 30*b* of the heat generating surface 30*a* with a simple structure.

Second Embodiment

Next, a second embodiment of the invention will be described with reference to FIG. 4. Note that the same reference numeral as in FIGS. 1 to 3 of the first embodiment designates the same or corresponding element in FIG. 4 and the overlapping description will be omitted.

Figure 4:
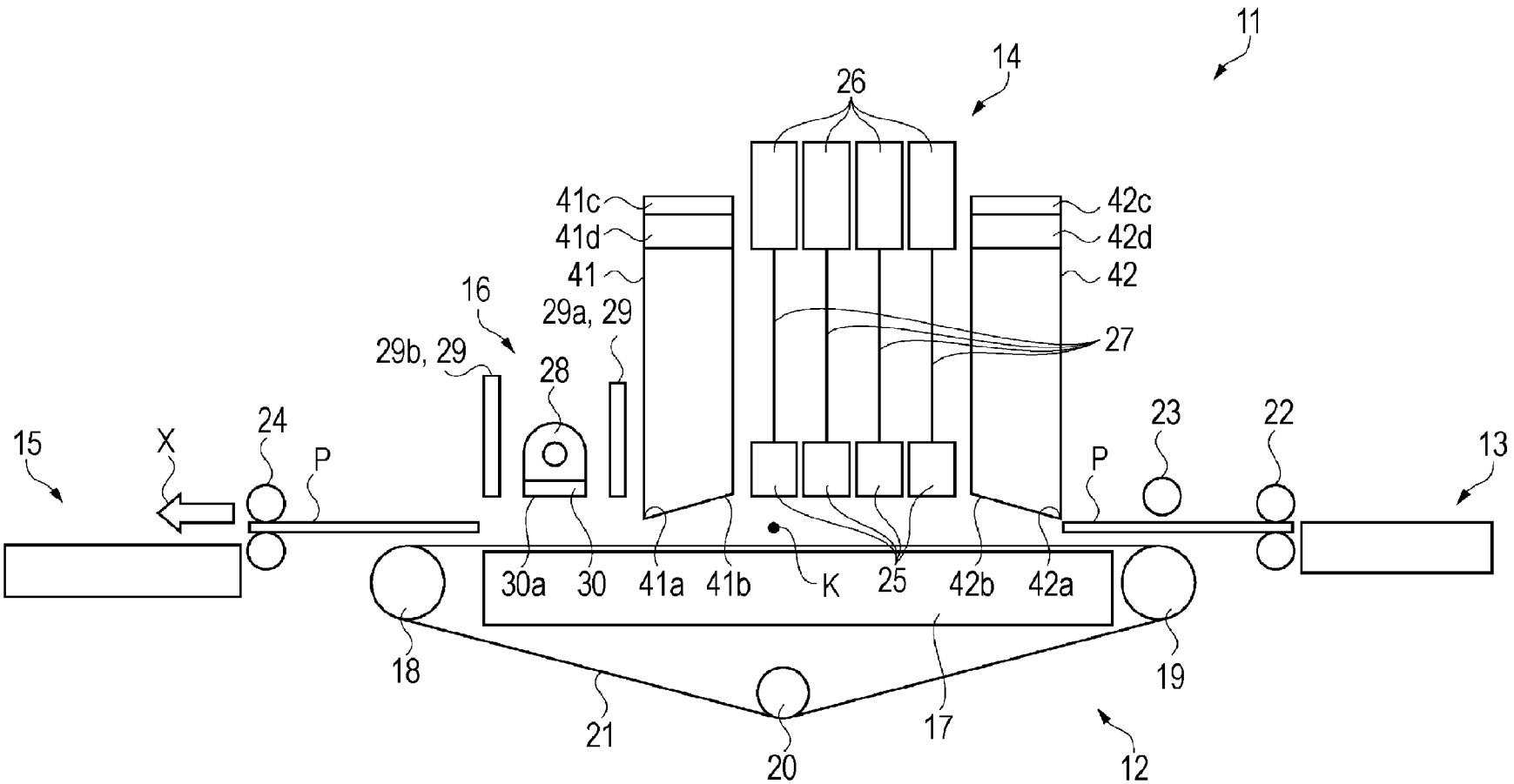
FIG. 4 is a diagram schematically showing an ink jet type printer according to a second embodiment.

As shown in FIG. 4, a first duct 41 and a second duct 42 as negative pressure generating means for generating a negative pressure in the ejection space K in which ink mist is floated are provided in the printer 11. The first duct 41 is provided between the recording heads 25 and the heat unit 16, and the second duct 42 is provided at the side opposite to the heat unit 16 with the recording heads 25 interposed therebetween (opposite side to the first duct 41). Accordingly, the first duct 41 and the second duct 42 are disposed to sandwich the recording heads 25, and the recording heads 25, the heat unit 16, the first duct 41, and the second duct 42 are arranged in parallel along the transport direction of the paper P.

Suction openings 41*a* 42*a* for suctioning the ink mist are formed in the ducts 41, 42. An opening face 41*b* of the suction opening 41*a* is opened toward the ejection space K and an opening face 42*b* of the suction opening 42*a* is opened toward the ejection space K.

Further, filters 41*c* 42*c* for recovering the suctioned ink mist are provided in the ducts 41, 42. The filters 41*c*, 42*c* are provided at the ends opposite to the opening faces 41*b*, 42*b* of the ducts 41, 42. Further, funs 41*d*, 42*d* for generating a negative pressure to suction the ink mist are provided beside the filters 41*c*, 42*c* at the side of the opening faces 41*b*, 42*b*. The funs 41*d*, 42*d* are driven by a driving source not shown to generate a negative pressure, and generate a suction force for suctioning the ink mist floated in the ejection space K toward inside the ducts 41, 42 from the ejection space K. The ink mist suctioned by the suction force is suctioned in the ducts 41, 42 via the suction openings 41*a*, 42*a* of the ducts 41, 42, and recovered by the filters 41*c*, 42*c*.

In the second embodiment, the effect corresponding to (1) of the first embodiment can be obtained, and the effects described below can be obtained.

(3) The ducts 41, 42 as the negative pressure generating means for generating a negative pressure in the ejection space K are provided in the printer 11, and the ink mist floated in the ejection space K is suctioned by the ducts 41, 42 via the suction openings 41*a*, 42*a*. Accordingly, the problem that the floating ink mist is adhered on the heat generating surface 30*a* to reduce light amount can be prevented.

(4) The first duct 41 is provided between the recording heads 25 and the heat unit 16, and the second duct 42 is provided at the side opposite to the heat unit 16 with the recording heads 25 interposed therebetween. Accordingly, the ducts 41, 42 can be provided near the ejection space K in which the ink mist is floated, and the floating ink mist can be easily suctioned. That is, the ink mist floating at the first duct 41 side in the ejection space K is suctioned by the first duct 41, and the ink mist floating at the second duct 42 side is suctioned by the second duct 42. Accordingly, the ink mist floating in the ejection space K can be effectively suctioned.

(5) The opening face 41*b* of the suction opening 41*a* is opened toward the ejection space K, and the opening face 42*b* of the suction opening 42*a* is opened toward the ejection space K. Accordingly, when suctioning the ink mist floating in the ejection space K, it becomes easy that the ink mist is suctioned toward the suction openings 41*a*, 42*a*.

Note that the embodiments may be modified as described below.

In the fist embodiment, the electrode member 31 may be a metal wiring, a conductive plastic wiring, or the like, and the metal wiring, the conductive plastic wiring, or the like may be embedded in the heat resistance glass 30 at the marginal portion 30*b* of the heat generating surface 30*a*.

In the second embodiment, the opening faces 41*b*, 42*b* of the suction openings 41*a*, 42*a* may be opening faces that are parallel to the heat generating surface 30*a*.

In the second embodiment, only any one of the first duct 41 and the second duct 42 may be provided.

In each of the embodiments, instead of the halogen heater 28, for example, a heat source such as a far-infrared ray heater, a carbon heater, or the like capable of heating a recording surface of the paper P without contact may be employed.

The liquid ejection apparatus is realized by the ink jet type recording apparatus used for printing. However, the invention is not limited to the ink jet type recording apparatus, and may be realized by a liquid ejecting apparatus for ejecting liquid except ink.

What is claimed is:

1. A liquid ejecting apparatus having a non contact type heater for heating a recording medium on which liquid is ejected via a liquid ejecting head, the heater having a heat generating surface and the heater being arranged in parallel to the liquid ejecting head along a transport direction of the recording medium, the liquid ejecting apparatus comprising:

a mist suctioning unit for suctioning floating mist generated by ejection of the liquid, the mist suctioning unit including a nozzle plate in which nozzle orifices for ejecting the liquid are formed, the nozzle plate being provided on the liquid ejecting head, an electrode member provided at a marginal portion of the heat generating surface, wherein the heat generating surface is a part of the heater, and an electric potential difference generator for generating an electric potential difference between the electrode member and the nozzle plate to electrostatically absorb the mist on the marginal portion of the heat generating surface.

2. The liquid ejecting apparatus according to claim 1, wherein the electrode member is formed by a thin film made of a metal, and the thin film made of the metal is attached at the marginal portion of the heat generating surface.

3. The liquid ejecting apparatus according to claim 1, wherein a heat resistance member for partitioning the heater and a transport mechanism for transporting the recording medium is provided in the heater, the heat resistance member includes the heat generating surface, the electrode member is made of a metal wiring, and the metal wiring is embedded in the heat resistance member at the marginal portion of the heat generating surface.

4. A liquid ejecting apparatus having a non contact type heater for heating a recording medium on which liquid is ejected via a liquid ejecting head, the heater having a heat generating surface and the heater being arranged in parallel to the liquid ejecting head along a transport direction of the recording medium, the liquid ejecting apparatus comprising:

a mist suctioning unit for suctioning floating mist generated by ejection of the liquid, the mist suctioning unit including a nozzle plate in which nozzle orifices for ejecting the liquid are formed, the nozzle plate being provided on the liquid ejecting head, an electrode member provided at a marginal portion of the heat generating surface, and an electric potential difference generator for generating an electric potential difference between the electrode member and the nozzle plate to electrostatically absorb the mist on the marginal portion of the heat generating surface, wherein the heater is located downstream in the transport direction from the liquid ejecting head.

5. The liquid ejecting apparatus according to claim 4, wherein the heater is positioned above a transport belt of the liquid ejecting apparatus.

* * * * *